United States Patent [19]

Frey

[11] 4,384,510

[45] May 24, 1983

[54] METHOD AND DEVICE FOR FEEDING LUBRICANT TO A CYLINDER-PISTON ARRANGEMENT

[75] Inventor: Bernhard Frey, Schaffhausen, Switzerland

[73] Assignee: Hydrowatt Systems Limited, London, England

[21] Appl. No.: 136,500

[22] Filed: Apr. 3, 1980

[30] Foreign Application Priority Data

Apr. 6, 1979 [CH] Switzerland ..... 3262/79

[51] Int. Cl.[3] ..... F01B 31/10

[52] U.S. Cl. ..... 92/156; 92/86.5; 92/105

[58] Field of Search ..... 92/86.5, 105, 153, 156

[56] References Cited

U.S. PATENT DOCUMENTS

| | | | |
|---|---|---|---|
| 2,027,979 | 1/1936 | Hopkins | 92/153 |
| 2,191,861 | 2/1940 | Rymal | 92/153 |
| 3,212,447 | 10/1965 | Browne | 92/48 |
| 3,453,995 | 7/1969 | Pelizzoni | 92/156 |
| 3,902,404 | 9/1975 | Breit | 92/86 |
| 4,218,961 | 8/1980 | Maasberg | 92/156 |

FOREIGN PATENT DOCUMENTS

| | | |
|---|---|---|
| 1040065 | 10/1978 | Canada . |
| 2554733 | 6/1976 | Fed. Rep. of Germany . |

*Primary Examiner*—Abraham Hershkovitz

*Attorney, Agent, or Firm*—Yount & Tarolli

[57] ABSTRACT

The method and the device for the lubricant feed works by introduction of the lubricant into a clearance volume (3b) between a, for example, tubular flexible sealing element of a cylinder-piston arrangement and a bearing surface within the working stroke at comparatively low working pressure. Consequently a comparatively low lubricant feed pressure is adequate. Return of lubricant into the feed is advantageously excluded by a non-return valve arrangement (8d,15).

Preferably a non-return valve member (15) is arranged in the region of the mouth (9) from the lubricant feed, whereby low-inertia operation results with secure maintenance of pressure in the lubricant space (3b).

5 Claims, 6 Drawing Figures

METHOD AND DEVICE FOR FEEDING LUBRICANT TO A CYLINDER-PISTON ARRANGEMENT

Figure 1:
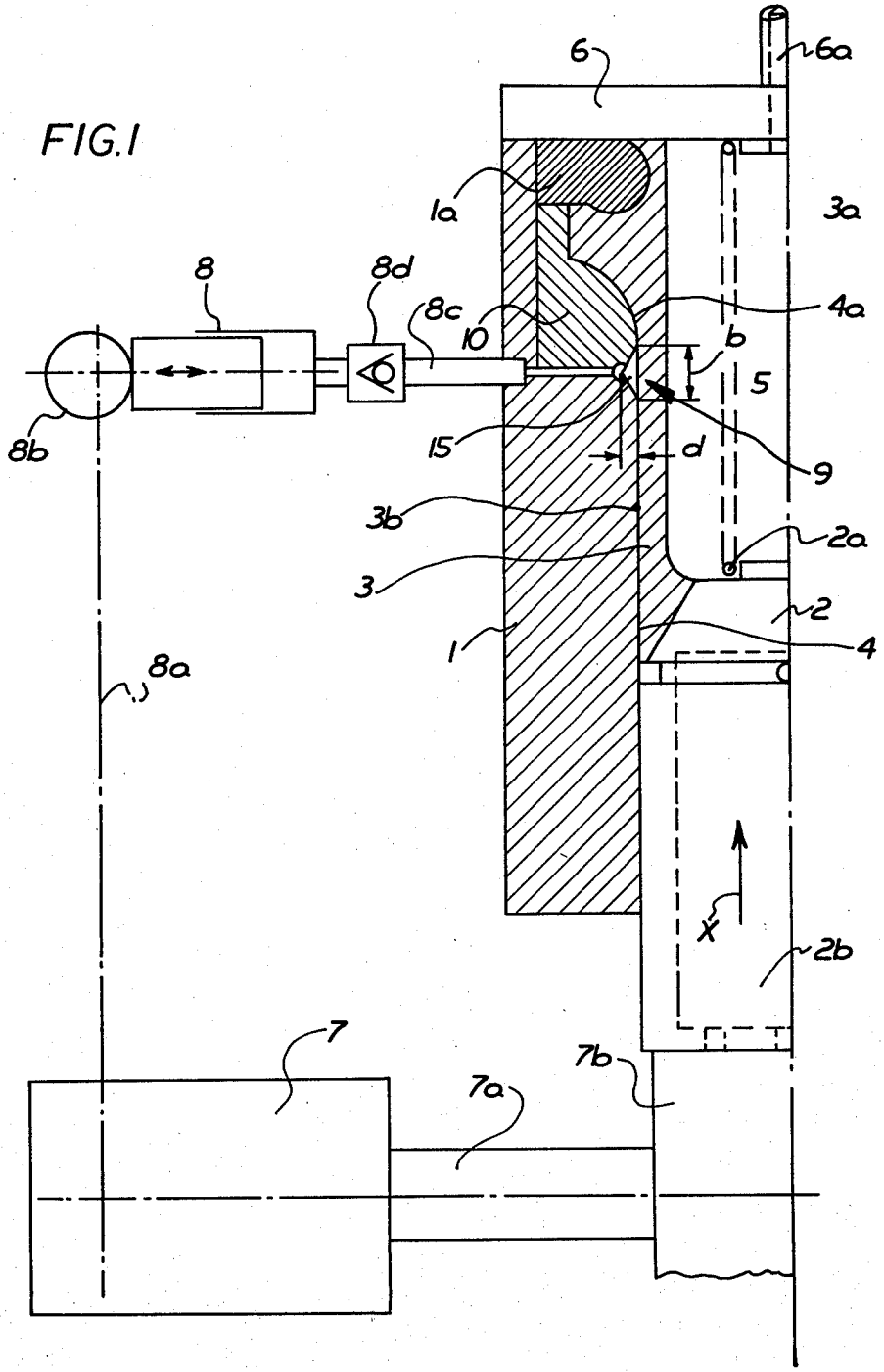

The invention refers to a method of feeding lubricant to a cylinder-piston arrangement having at least one working space lying under a pulsating working pressure as well as having at least one easily deformable bellows-like, in particular tubular, sealing element which bears at its surface against a lubricant space, the lubricant flowing through this space under a continuous feed. The invention further refers to a device for the lubricant feed to a cylinder-piston arrangement having at least two working members which define a pulsating working space as well as having at least one easily deformable bellows-like, in particular tubular, sealing element which via a lubricant space connected to a lubricant feed mechanism bears during its periodic deformation corresponding with the pulsation of the working space, against a bearing surface formed by a first working member.

A method and a device of the aforesaid kind are known from the West German O/S 25 54 733. The bearing here described in particular, of a tubular sealing element via a lubricant against a cylindrical bearing surface is effected with lubricant feed even during the pressure working stroke, i.e., the stroke with decreasing volume of the working space in the case of pump service or respectively with increasing volume of the working space in the case of motor service. The feed is effected, for example, by forcing in a quantity flow which is more or less independent of the counterpressure and subsequently leaves the lubricant space via a throttle point into a low-pressure chamber. In this way independently of the oscillations of the pressure in the working space (called below for short "working pressure") an equilibrium between the latter and pressure in the lubricant space can be achieved and thereby direct contact or mixed friction between the sealing element and the bearing surface can be avoided. Such a lubricant feed, however, demands a pump pressure which in any case lies above the maximum value of the working pressure, as well as a suitable control or regulation of the quantity flow in the feed. This is connected with comparatively high outlay.

The object of the invention is therefore the creation of a method and respectively a device for the feeding of lubricant to a cylinder-piston arrangement having a resilient sealing element of the kind mentioned initially, which fundamentally manages with a lubricant feed pressure which is lower with respect to the working pressure and does not need any control or regulation for a constant quantity flow in the case of the lubricant feed. The solution of this problem is in accordance with the invention is characterized as regards the method and the device respectively by the features specified in claim 1 and claim 4.

Because of this solution, at intervals of time at comparatively low working pressure there may be introduced at comparatively low feed pressure into the lubricant space between the sealing element and the bearing surface an amount of lubricant which taking into consideration the throttled discharge is adequate for safe bearing of the sealing element without contact or mixed friction against the bearing surface. In that case a reverse flow into the lubricant feed mechanism working at lower pressure is advantageously prevented by a non-return valve arrangement so that the necessary equilibrium between the lubricant pressure and the working pressure against the sealing element may rapidly establish itself. But if the occasion arises a definite reverse flow blocking or respectively a non-return valve arrangement may also be waived if the reverse flow resistance in the feed system allows the build-up of an adequate bearing pressure in the lubricant space.

In accordance with a further development of the invention, with the advantage of particular simplicity a variation in time of the lubricant feed pressure which is independent of the working stroke of the cylinder-piston arrangement and is preferably at least approximately constant, may be provided. This in particular enables in a simple way a common lubricant feed for a multi-cylinder-piston arrangement with a corresponding plurality of sealing elements.

On the contrary another further development of the invention provides that the lubricant feed pressure exhibits a variation in time which is synchronous with respect to the periodic alteration in the working space of the cylinder-piston arrangement, with maximum values in the regions of the working stroke between the maximum values of the working pressure, i.e., at low working pressures. Such an execution presents itself above all for arrangements having only one sealing element or a small number of such elements, where in each case a lubricant pump may be coupled with the drive of the cylinder-piston pair in question.

An important further development of the device in accordance with the invention is characterized in that the non-return valve arrangement exhibits at least one valve member arranged in the region of the mouth from the lubricant feed into the lubricant space. By this arrangement of the valve member of the non-return valve arrangement there results a particularly low-inertia blocking of the lubricant feed channel at the start of the increase in the working pressure. Above all at very high working pressures which would make necessary the taking into consideration of the compressibility of the lubricant and of the elastic resilience of the feed pipes and other feed members, this signifies a considerable relief from loading of the whole feed mechanism and avoids a reduction in the volume of lubricant effective for the bearing and thus secures the sealing element against contact with the unevennesses at the mouth of the lubricant feed and thereby against damage.

Figure 2:
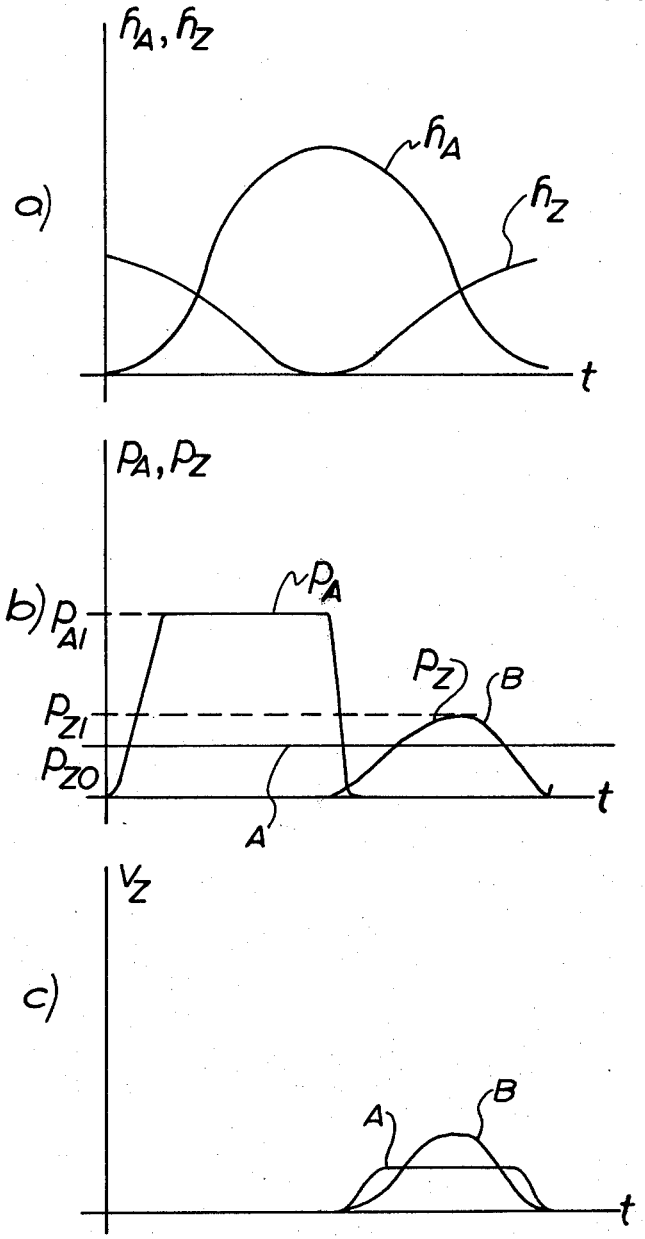
Figure 3A:
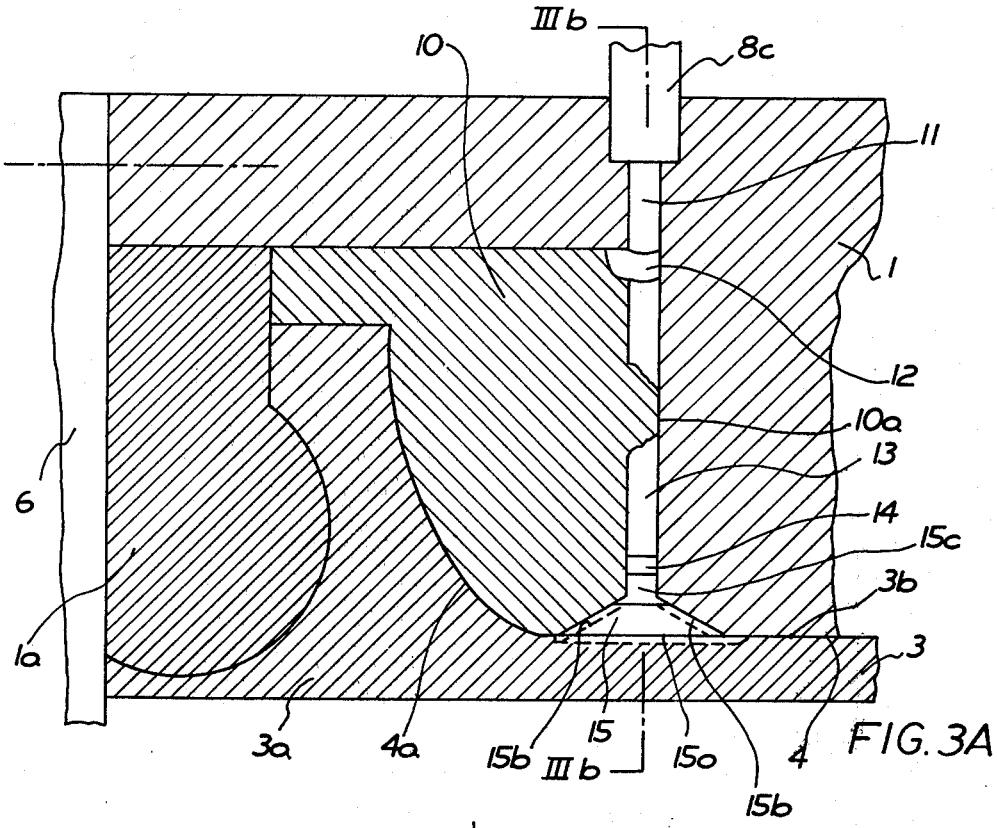
Figure 3B:
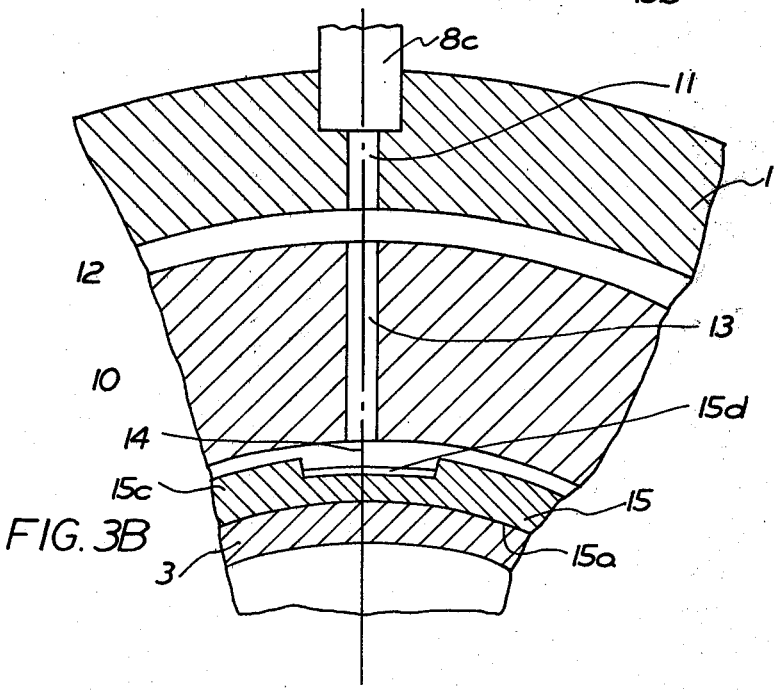
Figure 4:
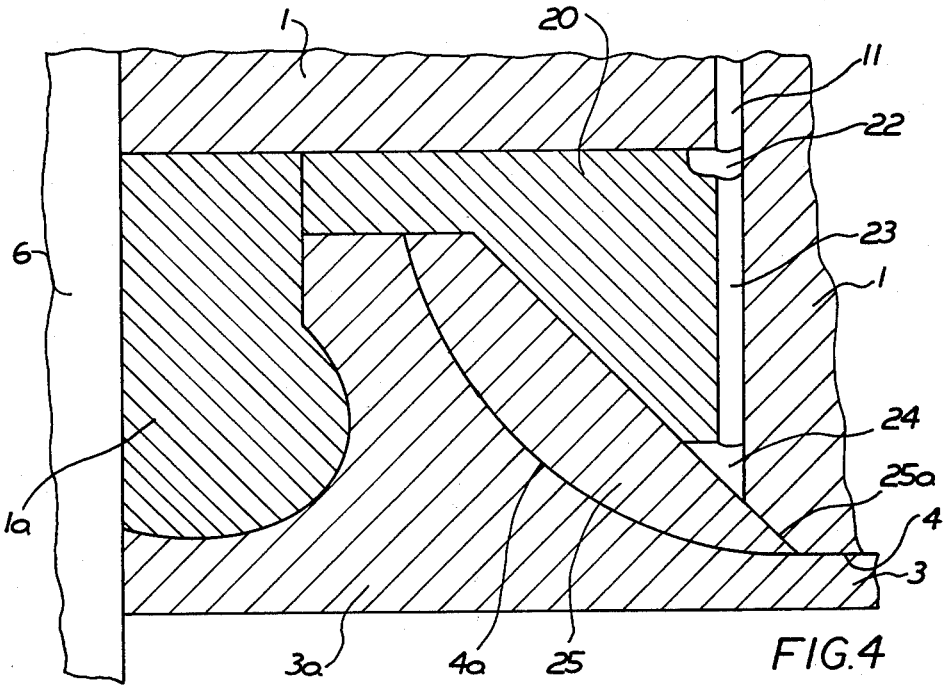
Figure 5:
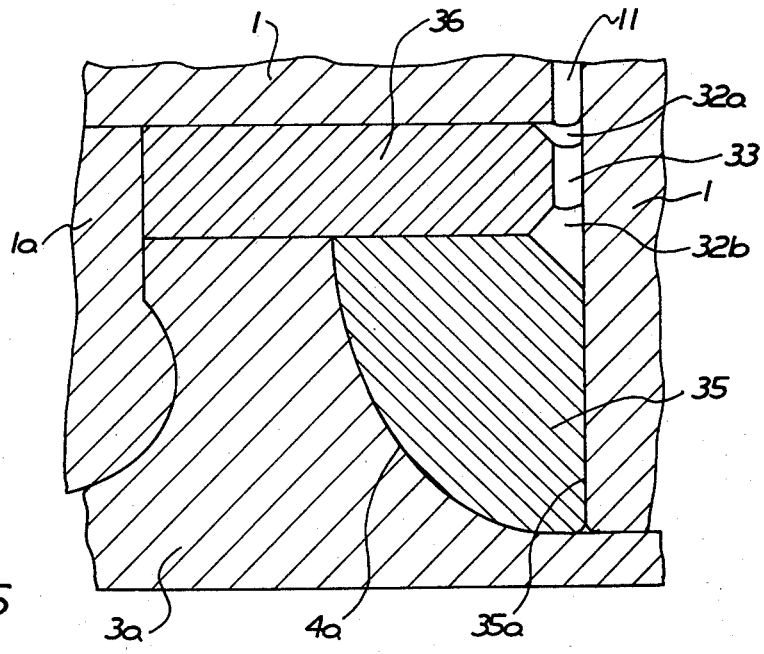

The invention is further explained with the aid of the embodiments illustrated in the drawings. In these there is shown in:

FIG. 1—a cylinder-piston arrangement having a tubular sealing element and a driving and lubricant feed mechanism indicated diagrammatically;

FIG. 2—in three graphs (a), (b) and (c) the variation in time of various operating quantities of the cylinder-piston arrangement, essential for the lubricant feed;

FIGS. 3*a* and 3*b*—on a larger scale an axial section and a section transversely to the axis respectively through the connection region of a sealing tube to a working cylinder with a non-return valve arrangement; and FIGS. 4 and 5—each an axial section through the connection region of a sealing tube with two modified executions of non-return valve arrangements.

In the case of the arrangement as in FIG. 1 a cylinder 1 as a first working member and a piston 2 as a second working member are connected together via a tubular sealing element 3 which bears against a cylindrical bearing surface 4 on the first working member. In the radially thickened connection region 3*a* of the sealing element 3 to the cylinder 1 the bearing surface 4 forms a transition section 4*a* of the surface curved toroidally outwards. The connection region 3*a* has a connection of the substance of the material, for example, by vulcanization to an intermediate ring 1*a* of the cylinder 1. In this connection region lies the mouth of the lubricant feed which is still to be explained. At the oppostie end the sealing element likewise has a connection of the substance of the material to a conical face on the piston 2. A spiral compression spring 2*a* forces downwards the shank 2*b* which is guided to be able to be displaced in the cylinder 1, against an oscillating driving member so that the working space 5 formed inside the sealing element is reduced in the case of a movement in accordance with the arrow X. In the illustration the piston 2 adopts its bottom position with maximum volume of the working space. At the top the working space is connected by a cover 6 to the feed and discharge pipe 6*a* to a valve arrangement (not shown) for a way of working of the device as a pump. Between the sealing element 3 and the bearing wall 4 there is a lubricant space 3*b* in the form of a crevice of small radial thickness, the lubricant filling in which excludes contact between the sealing element and the bearing surface upon the oscillating longitudinal stretching of the sealing element corresponding with the piston motion. A motor unit 7 with a driving shaft 7*a* and cam 7*b* is provided as the drive for the piston motion, the shank 2*b* of the piston being pressed against the latter by the compression spring 2*a*. A lubricant feed mechanism with a pump 8 is further coupled to the motor unit 7 via a diagrammatically indicated shaft 8*a* and a cam 8*b*. A non-return valve 8*d*, for example, may be inserted in the lubricant feed pipe 8*c* but preferably the mouth 9 from the lubricant feed is provided with a non-return valve member 15 having a low-inertia action. The mouth 9 from the lubricant feed lies at the underside of an annular body 10, provided with corresponding outlet grooves, and forming on its upper side the section 4*a* of the transition surface. During the oscillating stretching of the sealing element the tensile forces inside the sealing material are deflected towards the outside by the curvature of this surface section and distributed over the connection of the substance of the material to the intermediate ring 1*a*.

The graphs in FIG. 2 referred to service of the cylinder-piston arrangement as a pump, i.e., with high working pressure in the case of decreasing volume of the working space. In the graph (a) the variation of the stroke $h_A$ of the working piston 2 and of the pump stroke $h_Z$ of the lubricant feed pump with respect to the time t is indicated. This way of working corresponds with a lubricant feed synchronized with the working stroke at increasing volume of the working space. The associated variation in time of the lubricant feed pressure $p_Z$ is indicated in the curve B of the graph (b). This feed allows of a comparatively low maximum feed pressure $p_{Z1}$. The variation in time of the lubricant quantity flow $v_Z$ is indicated in the graph (c) by the curve B. On the other hand with the advantages mentioned in the introduction an asynchronous lubricant feed may be applied, for example, at an essentially constant feed pressure $p_{ZO}$ in accordance with the line A in the graph (b). Here too a penetration of lubricant into the space 3*b* of the arrangement as in FIG. 1 results in the region of the working stroke with increasing volume of the working space, i.e., at low working pressure, with a quantity flow $v_Z$ in accordance with curve A in the graph (c).

In FIGS 3*a* and 3*b* the form of the mouth from the lubricant feed with a non-return valve against the end face 10*a* of the annular body 10 is shown in detail. A radial channel 11 in the cylinder 1 is connected to the feedpipe 8*c* as well as a circumferential distributor groove 12 on the annular body 10 and further a plurality of radial feed grooves 13 inside the end face 10*a*. The radial feed grooves 13 open into an inner circumferential groove 14 between the annular body 10 and the cylinder 1, which acts as the terminal distributor for the lubricant feed into the clearance space 3*b*. The mouth 9 itself is formed by a circumferential groove which in cross-section is of a flat triangular shape, into which is inserted an annular radially deformable valve member 15. The base 15*a* of the annular cross-section facing the sealing element 3 exhibits a width b which is dimensioned to be considerably larger than the radial height d of the cross-section, so that faces 15*b* result on the rear of the ring which are inclined at an acute angle with respect to the cylindrical part of the bearing surface 4. As soon as the lubricant feed pressure adequately exceeds the working pressure acting on the inside of the sealing element, the annular valve member 15 is deformed radially inwards as is indicated in FIG. 3*a* in dotted line. At the rear faces 15*b* of the ring outlet channels thereby result which open out at an acute angle into the lubricant space 3*b* and upon the working pressure being exceeded they are closed again automatically with radial outwards stretching of the ring. The annular valve member may if necessary consist of a material which is stiff against deformation but comparatively resilient, in particular of a plastics which slides readily, so that low differences in pressure are adequate for rapid valve actuation and furthermore only low loading of the surface of the sealing element occurs by contact with the valve member. The low mass of the annular valve member also contributes to low-inertia operation.

On the outside of the annular valve member 15 an annular extension 15*c* running in the circumferential direction is provided, which engages snugly in the circumferential groove 14 and secures the valve member against axial shifting. As may be seen from FIGS. 3*b* notches 15*d* are provided in the annular extention 15*c* and engage radially inwards in the region of the rear faces 15*b*. Consequently the lubricant can get out of the circumferential groove 14 into the outlet channels formed on the rear faces 15*b* upon radial inwards deformation if the radial inwards deformation has only come to a small amount. This contributes too to low-delay operation of the non-return valve.

In the case of the execution of the non-return valve as in FIG. 4 there are connected to the feed pipe 8*c* and the radial channel 11 a circumferential distributor groove 22 as well as radial channels 23 and a terminal distributor groove 24 inside the righthand end face of an annular body 20. The transistion section 4*a* of the surface is formed by an annular valve member 25 separate from the annular body 20 and axially displaceable because of the deformability of the connection region 3*a* of the sealing element, this valve body 25 closing by its rear face 25*a* the mouth of the lubricant feed when the working pressure exceeds the lubricant feed pressure. Upon axial shifting of the valve member 25 towards the left in the sense of FIG. 4 the bottom section of the rear face 25*a* releases the passage into the lubricant 3*b*. Here too a discharge of the flow of lubricant results again at an acute angle with respect to the cylindrical part of the bearing surface 4, which contributes to a uniform and rapid distribution of the lubricant.

The annular valve member 25 may for the rest instead of or if necessary in addition to its axial displaceability exhibit a radial deformability, which may readily be achieved by the choice of appropriate material. In the case of the inwards deformation the cross-section of the annular body in the case of the execution as in FIG. 4 may easily be twisted so that the inner edge region of the rear face 25*a* lifts from the cylinder whilst the outer region of the ring still bears. In this way a slight deformation of the annular body is sufficient for the valve action.

In the case of the execution as in FIG. 5 an axially displaceable annular valve member 35 is provided, which in the flow state rests by its right hand end-face 35*a* against a corresponding flat endface of the cylinder 1 and under the action of the lubricant feed pressure is shifted towards the left to open. For that purpose the valve member is fitted radially into a spacer ring 36 which exhibits at its righthand endface circumferential distributor grooves 32*a* and 32*b* as well as radial channels 33 for the outlet of the lubricant to the righthand endface of the valve member 35. Such an execution comes into consideration particularly also for the employment of non-deformable materials capable of wear for the valve member 35.

I claim:

1. An apparatus comprising a piston and a cylinder, said piston being in part located in said cylinder and said piston and said cylinder being relatively movable, an elastic sealing element sealingly engaging said piston and said cylinder at spaced locations and at least partially defining a working chamber having a working pressure therein, the volume of said working chamber and said working pressure prevailing therein varying with time, said sealing element having a surface portion bearing against a bearing surface of said cylinder via a lubricant space as the volume of said working chamber varies, and a lubricant feed mechanism for supplying lubricant to said lubricant space at a feed pressure lower than the maximum value of said working pressure, said lubricant space comprising a clearance volume of small thickness between said surface portion of said sealing element and said bearing surface, said lubricant feed mechanism having a mouth opening into said lubricant space, and further comprising a non-return valve having at least one valve member located in said mouth, said non-return valve comprising a valve seat comprising at least one surface of said bearing surface defining an annular groove encircling said sealing element and at least one annular radially deformable valve member located within said annular groove and movable radially within said groove.

2. An apparatus as in claim 1, wherein said annular valve member has a base side facing said sealing element, and at least two other sides facing said bearing surface, said base side and said other sides defining a generally triangular cross section, said annular valve member having a maximum height of cross section less than the width of said base side.

3. An apparatus as in claim 1 or 2, further comprising locating means for preventing axial movement of said valve member, said locating means comprising radially outward extensions at spaced locations on a side of said annular valve member remote from said base side, said extensions being received in radially outward extensions of said annular groove.

4. An apparatus comprising a piston and a cylinder, said piston being in part located in said cylinder and said piston and said cylinder being relatively movable, an elastic sealing element sealingly engaging said piston and said cylinder at spaced locations and at least partially defining a working chamber having a working pressure therein, the volume of said working chamber and said working pressure prevailing therein varying with time, said sealing element having a surface portion bearing against a bearing surface of said cylinder via a lubricant space as the volume of said working chamber varies, and a lubricant feed mechanism for supplying lubricant to said lubricant space at a feed pressure lower than the maximum value of said working pressure, said lubricant space comprising a clearance volume of small thickness between said surface portion of said sealing element and said bearing surface, said lubricant feed mechanism having a mouth opening into said lubricant space, and further comprising a non-return valve having at least one valve member located in said mouth, wherein a part of said bearing surface extends radially outwardly to form a transition section in the region where said elastic sealing element sealingly engages said cylinder, said transition section having a conical or toroidal shape, and wherein at least a part of said transition secton comprises a surface of an annular valve member, located adjacent said mouth, said annular valve member being axially movable and/or radially deformable for opening and closing said mouth.

5. An apparatus as in claim 4, wherein said annular valve member has a first side facing said mouth, said first side being made as a section of a conical surface, said first side engaging said bearing surface at an acute angle.

* * * * *